US005831376A

United States Patent [19]

Ho et al.

[11] Patent Number: 5,831,376

[45] Date of Patent: Nov. 3, 1998

[54] ELECTRO MAGNETIC CONTROLLED PLATINUM INFRARED FILAMENT IGNITOR

[75] Inventors: Wu-Chi Ho; Chii Ron Kuo; Bor Rong Jong; Tseng Wuu Wey; Chung Yen Chang, all of Hsinchu, Taiwan

[73] Assignee: Industrial Technology Research Institute, Hsinchu, Taiwan

[21] Appl. No.: 742,760

[22] Filed: Nov. 1, 1996

[51] Int. Cl.[6] ..... F02P 19/02

[52] U.S. Cl. ..... 313/125; 123/145 A

[58] Field of Search ..... 313/118, 125; 123/145 A, 179.6; 361/265, 266

[56] References Cited

U.S. PATENT DOCUMENTS 4,240,392 12/1980 Matayoshi ..... 123/145 A 4,397,273 8/1983 Folkerts ..... 123/145 A 5,254,838 10/1993 Hasegawa et al. ..... 123/145 A

*Primary Examiner*—Sandra L. O'Shea

*Assistant Examiner*—Michael Day

*Attorney, Agent, or Firm*—Bacon & Thomas

[57] ABSTRACT

An electro magnetic controlled platinum infrared filament ignitor has a screw nut, a top pin, an electro magnetic induction coil, a magnetic permeable bolt, a metal wrapped cylinder and a platinum filament. Heat produced by current flowing in the platinum filament actuates the ignitor. The magnetic force set up by the energized coil, and spring force drives the adjustable top pin to the position of the platinum filament. The ignitor is simple in construction with endurable long life and efficient for ignition in most gas turbines, reciprocating engines and gas burners.

13 Claims, 6 Drawing Sheets

ELECTRO MAGNETIC CONTROLLED PLATINUM INFRARED FILAMENT IGNITOR

BACKGROUND OF THE INVENTION

1. Field of the Invention

The present invention relates to an infrared filament ignitor whose ignition position is controlled with a magnetic force induced by a coil and a restoring force of a spring to improve the successful ignition rate and lengthen the life of said ignitor which is especially applicable in the field of ignition systems for gas turbines, reciprocating engines and gas burners.

2. Description of the Prior Art

The spark ignitor and the infrared filament ignitor are popularly known at the present time. The former has been widely adopted in gas turbines, and internal combustion engines, while the latter is not often in use.

FIG. 1 is a drawing showing a conventional spark ignitor. A spark generator produces a high voltage which sets up impulse sparking between the intermediate electrode and the external electrode. Using the high voltage produced by its auxiliary equipment for its the spark source, the conventional ignitor can not avoid the following disadvantages:

1. Since a high ignition energy is necessary, its high instantaneous voltage may ruin the reactor and instruments nearby, or even burn them up.

2. The intermittent impulse voltage produced by the spark generator is unable to perform consistent ignition and may cause carbon pilling between the electrodes making the ignition even more difficult.

3. Sparking between the narrow gap between two electrode makes it difficult to perform complete ignition.

FIG. 2 is the schematic drawing showing a conventional infrared filament ignitor which utilizes the high temperature heat produced by current flowing in a resistive filament wire for ignition. In spite of its simpler construction compared to that of the spark type, it has some disadvantages as follows:

1. It is easy to entail incomplete contact or insulation failure between the two electrodes.

2. The ignitor is exposed to the high temperature or high pressure environment after accomplishing ignition that is apt to be burned or cracked.

3. For the purpose of perfect ignition and avoiding being burned by high temperature, the ignitor should possess high ignition energy and not to extend too deep into the combusting zone.

4. The ignitor itself may become an obstacle that interferes with the flow of combustion gas forming an interrupted flow zone of the combustion gas surrounding the ignitor.

SUMMARY OF THE INVENTION

The ignitor according to the invention comprises screw nuts, a top pin, an electro magnetic induction coil, a magnetic permeable bolt, a spring, a metal wrapped cylinder and a platinum filament. A magnetic field is built up in the magnetic permeable bolt when the electro magnetic induction coil is energized, the top pin is attracted and pushes the metal wrapped cylinder below it, and the platinum filament installed at the end of the cylinder is in turn pushed into the combustion gas. At the same time, the platinum filament is heated by the current flowing in it to an infrared state to ignite the combustion gas and the ignitor's function is thus accomplished. After ignition, the current flowing in said coil and the platinum filament is interrupted, the magnetic field of the coil is lost while the restoring force of the spring pushes said cylinder upwards. The platinum filament having accomplished its ignition function, returns to the isolating chamber. The ignitor's stroke is controlled by adjusting the screw nut which determines the extending length of the top pin.

The above described mechanism is a normally closed type which means the platinum filament stays in the isolating chamber when the coil is de-energized. The present invention includes another normally open type ignitor which means the platinum filament remains in the combustion gas when the coil is de-energized. The operation principle of the two type of ignitors are identical, the only difference is that the location of the platinum filament is reversed with respect to the states of the coil before and after energization.

The main purpose of the present invention is to develop an electro magnetic controlled platinum infrared filament ignitor which utilizes the heat produced by the current flowing in the platinum filament to raise its temperature up to an infrared state and to push it deeply into the combustion gas zone for perfect ignition.

Another purpose of the present invention is to develop an electro magnetic controlled platinum infrared filament ignitor which utilizes the magnetic field set up by an electro magnetic induction coil, the restoring force of a spring and an adjustable screw nut for controlling the position of the platinum filament, hence the ignitor's position in the combustion gas zone can be properly adjusted according to the situation required for assuring perfect ignition.

Another purpose of the present invention is to develop an electro magnetic controlled platinum infrared filament ignitor in which after having accomplished ignition, the platinum filament can return to the isolating chamber without having the being exposed to the high temperature or high pressure environment as in the conventional infrared filament ignitor. The high energy for ignition is not necessary. It will not interfere with the flow of combustion gas, and it is able to lengthen its life time with high reliability. Besides, returning of the ignitor to the isolating chamber after completion of ignition assures uniform flow of the cooling air helpful for improving a cooling effect.

Another purpose of the present invention is to develop an electro magnetic controlled platinum infrared filament ignitor which is not only simple, but firm and rugged in construction, suitable for practical usage with low production cost. Only one electricity supply source is needed for operation without any peripheral equipment. Said ignitor possesses all of the advantages of conventional spark ignitor as well as the infrared filament ignitor but is free from their disadvantages. The present invention is applicable to the ignition systems for a gas turbine as well as for the reciprocating engine in the automobile industry. Besides, it may be also applicable to the ignition system for gas burners.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
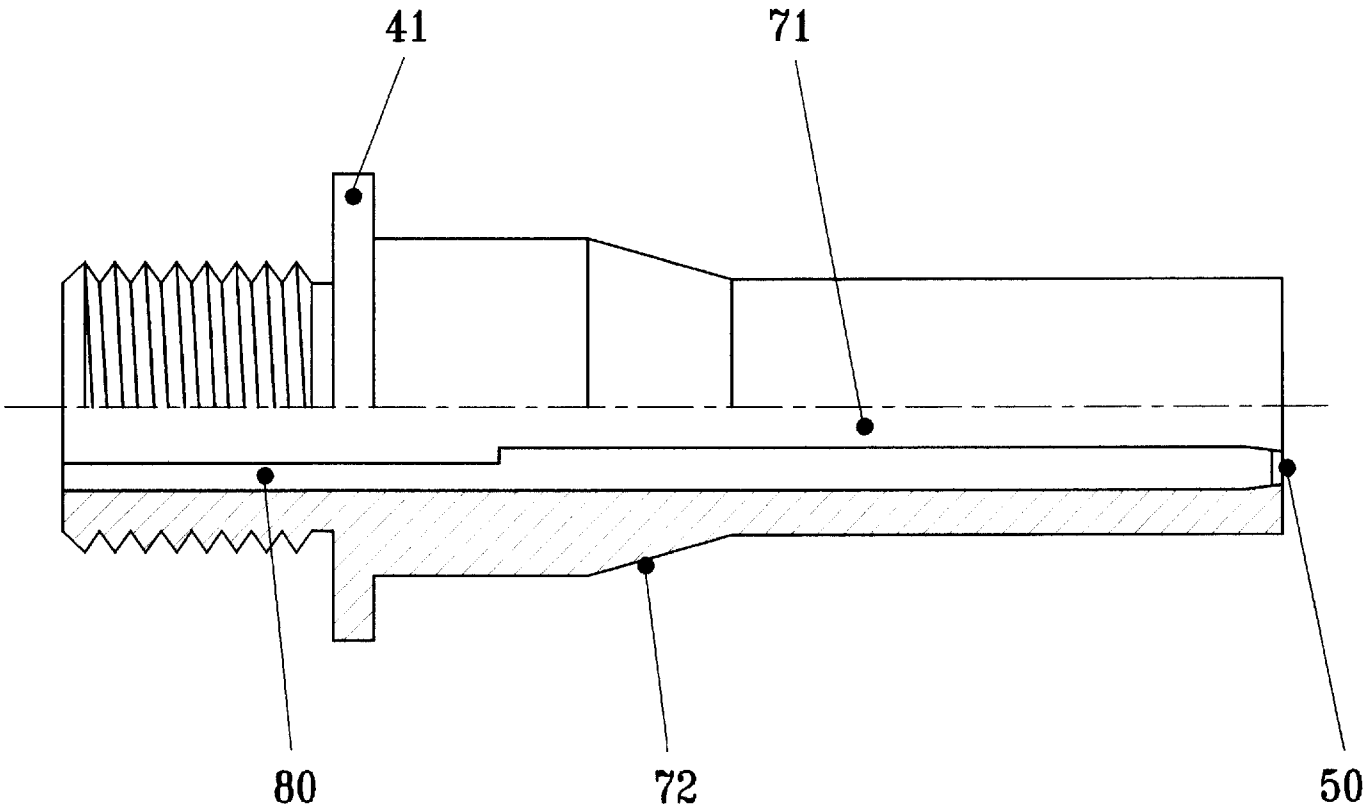
FIG. 1 is a cross sectional view of a conventional spark ignitor.

FIG. 1 is a cross sectional view showing the construction of a conventional spark ignitor wherein an intermediate electrode 71 is installed and isolated from the external electrode 72 having metallic flange base 41, by the insulated body 80 and a semi conductor 50. An impulse spark is set up between the two electrodes by the high voltage built up by the spark generator. An ignitor constructed as such needs not only high energy for ignition, but also is unable to avoid incomplete ignition owing to the intermittent sparking. This is a serious disadvantage of this type of ignitor.

Figure 2:
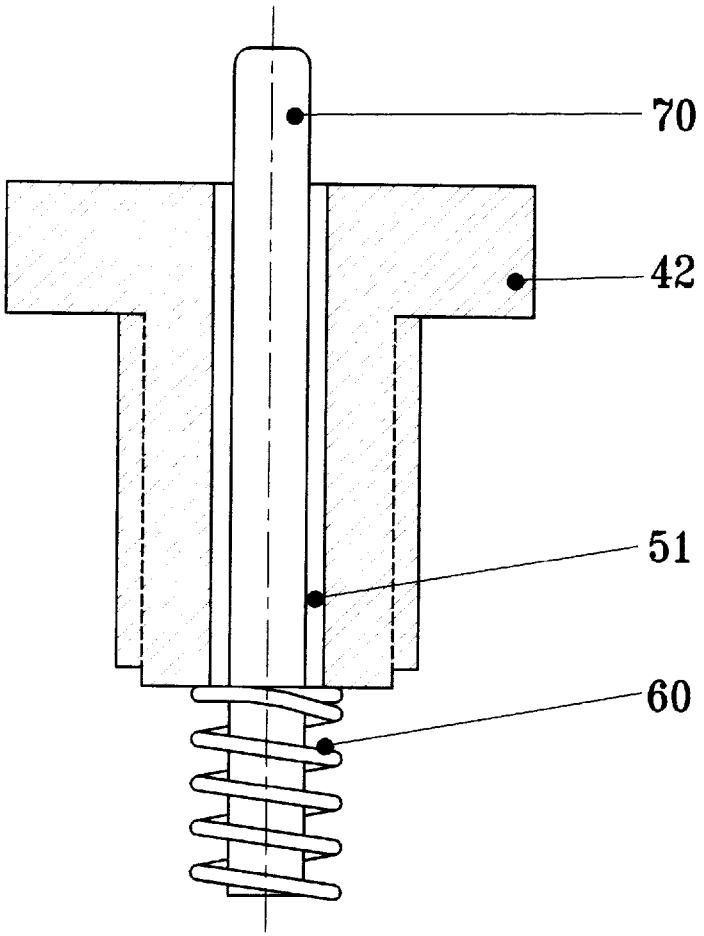
FIG. 2 is a cross sectional view of a conventional infrared filament ignitor.

FIG. 2 is a cross sectional view showing the construction of a conventional infrared filament ignitor in which the electrode 70 is installed inside the metallic flange base 42, and is isolated from the external conductive metal by a semi conductor 51. The resistive wire filament 60 is made infrared by the current flowing in it, utilizing the produced heat to perform the ignition. The structure of this type of ignitor is simpler than that of a conventional spark ignitor and can save the peripheral equipment, but it has the disadvantage that after having performed ignition, the ignitor is exposed to the high temperature or high pressure environment and may be burnt or cracked.

Figure 3A:
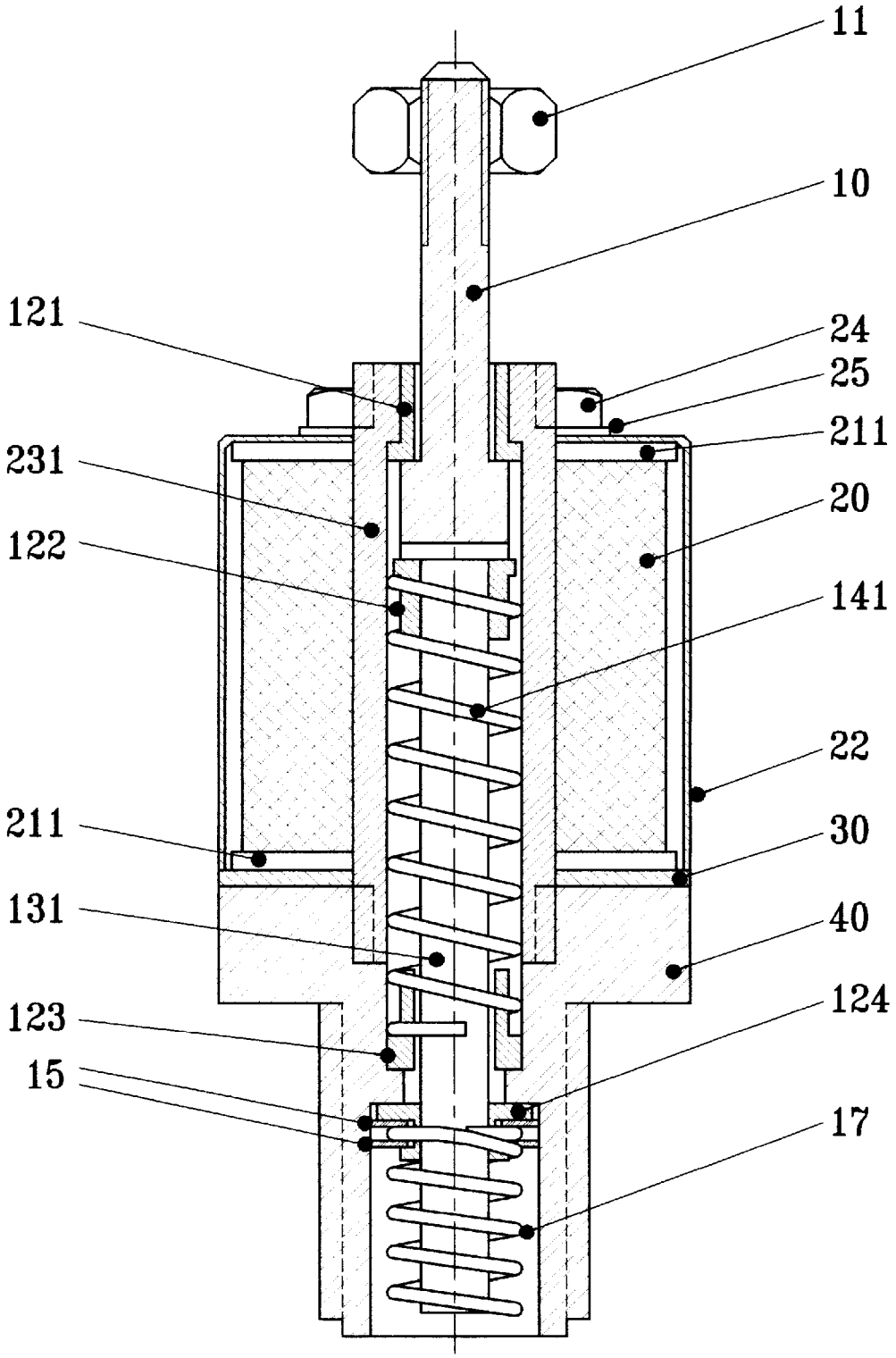
FIG. 3A is a cross sectional view of the normally closed electro magnetic controlled platinum infrared filament ignitor according to the invention with the coil not energized.
Figure 3B:
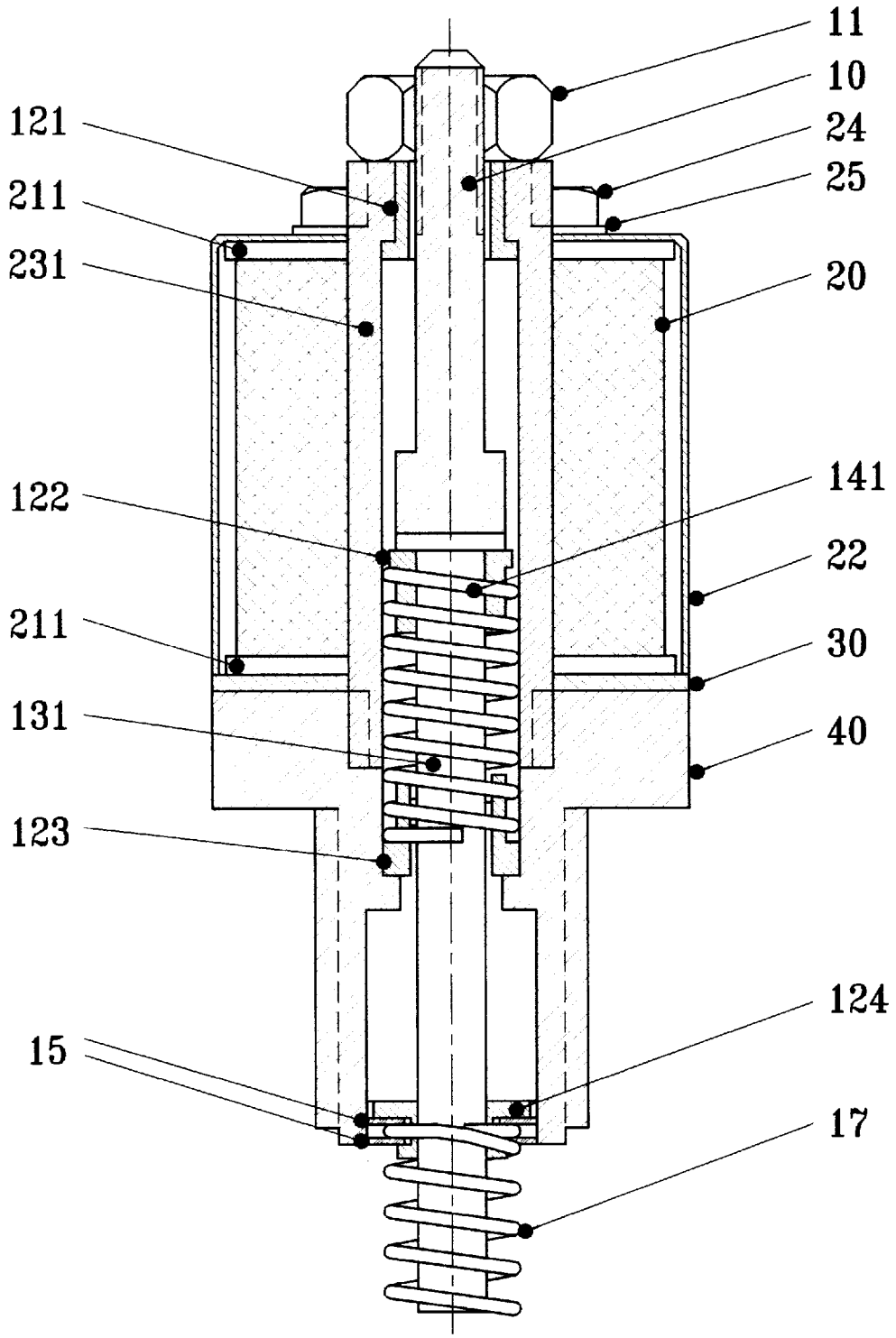
FIG. 3B is a cross sectional view of the normally closed electro magnetic controlled platinum infrared filament ignitor according to the invention with the coil energized.

FIGS. 3A and 3B are cross sectional views showing the construction of the normally closed electro magnetic controlled platinum infrared filament ignitor according to the invention which comprises a screw nut 11, a top pin 10, a magnetic permeable screw bolt 231, an electro magnetic induction coil 20, a metal wrapped cylinder 131, a metal enclosure 22, a platinum filament 17 and a metallic flange base 40.

The screw nut 11 is installed on top of pin 10 for adjusting the up and down stroke of the top pin 10 when it is actuated by the magnetic field, the igniting position of the platinum filament shown in FIG. 3B is in turn controlled by the movement of the top pin 10.

The top pin 10 is in contact at its bottom with the metal wrapped cylinder 131. The current flows via top pin 10, metal wrapped cylinder 131 and the platinum filament 17 installed at the end of said cylinder 131, and finally flows out from the metallic flange base 40.

The magnetic permeable bolt 231 is hollow in its inner portion whose upper part is isolated from the top pin 10 by the insulation cover 121. It has M6 threads at its lower portion for fastening to the metal flange base 40.

The electro magnetic induction coil 20 is isolated from the metal enclosure 22 by the insulating washer 211, and is also isolated from the metal washer 30 by another insulating washer 211 beneath it. After the coil 20 has been energized as illustrated in FIG. 3B, the magnetic permeable bolt 231 attracts the top pin 10 with its magnetic force.

The metal wrapped cylinder 131 is surrounded by wound spring 141 on its surface. It is isolated from the top pin 10 by the insulation cover 122 on the top and also isolated from the metallic flange base 40 by another insulation cover 123 at its bottom. After the coil 20 is de-energized, the cylinder 131 recovers its original state, shown in FIG. 3A, by the restoring force of the spring 141 beaming against the metallic flange base 40.

The metal enclosure 22 encloses the electro magnetic induction coil 20 and is fixed on the metallic flange base 40 by means of the screw nut 24 on its top and two metal washers 25 and 30 on its top and at its bottom respectively.

The platinum filament 17 in a spiral shape is connected to the end of the metal wrapped cylinder 131 at one terminal and to two conductive metal pieces 15 at the other terminal. The upper conductive metal piece is isolated from the metallic flange base 40 by the insulation cover 124.

The metallic flange base 40 is threaded with M8 threads on its surface so that it can be fixed to other parts. The current flows in from top pin 10, passes through metal wrapped cylinder 132 and reaches the platinum filament 17 installed at the end terminal of the metal wrapped cylinder 132 for producing heat, and flows continuously onwards via conductive metal piece 15 and finally goes out from the metallic flange 40.

Figure 4A:
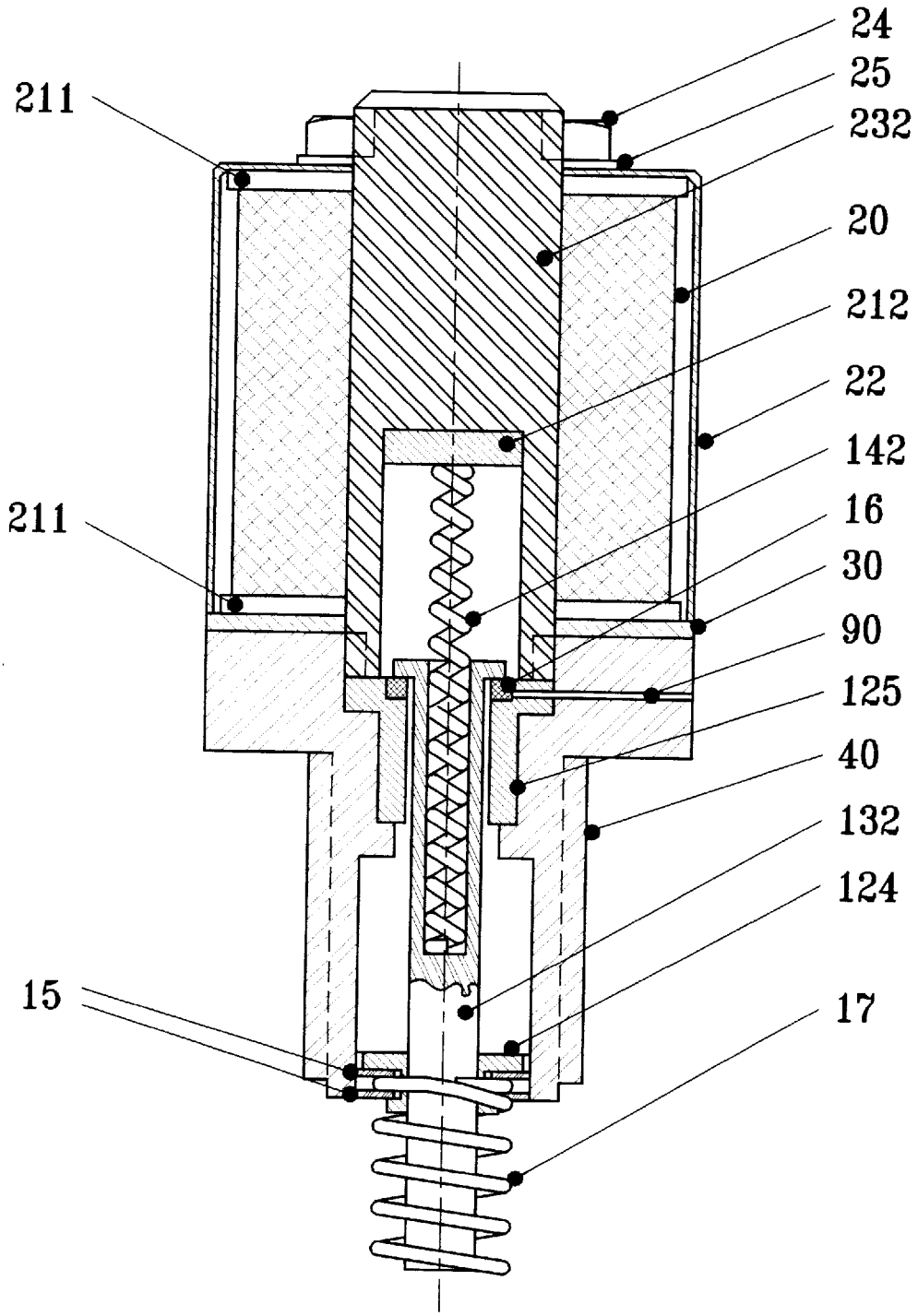
FIG. 4A is a cross sectional view of the normally opened electro magnetic controlled platinum infrared filament ignitor according to the invention with the coil not energized.
Figure 4B:
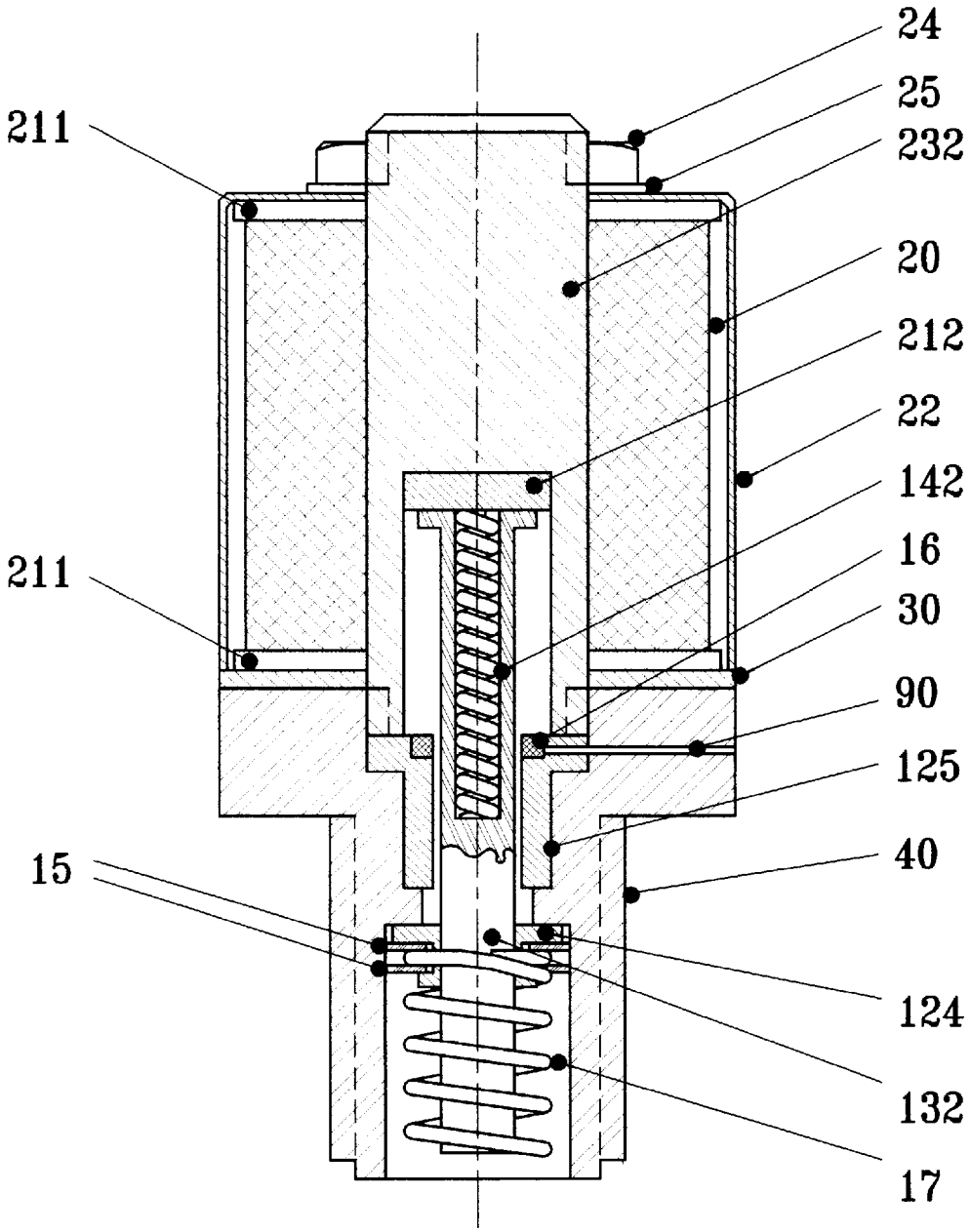
FIG. 4B is a cross sectional view of the normally opened electro magnetic controlled platinum infrared filament ignitor according to the invention with the coil energized.

FIGS. 4A and 4B are cross sectional views of the normally opened type of electro magnetic controlled platinum infrared filament ignitor according to the invention which comprises a magnetic permeable bolt 232, an electro magnetic induction coil 20, a metal wrapped cylinder 132, a metal piece 16, a metal enclosure 22, a platinum filament 17 and a metallic flange base 40.

The magnetic permeable bolt 232 is hollow in its inner portion whose lower part is threaded with M6 threads for fixing to the metallic flange base 40.

The electro magnetic induction coil 20 is isolated from the metal enclosure 22 by the insulating washer 211, and is also isolated from the metal washer 30 by another insulating washer 211 beneath it. After the coil 20 has been energized, as illustrated in FIG. 4B, the magnetic permeable bolt 232 attracts the metal wrapped cylinder 132 with its magnetic force.

The metal wrapped cylinder 132 is hollow with the spring 142 installed inside. Its top portion is isolated from the magnetic permeable bolt 232 by the insulating washer 212. After the coil 20 is de-energized, as illustrated in FIG. 4A, the metal wrapped cylinder 132 returns to its original extended state by the restoring force of spring 142 released from holding by the magnetic permeable bolt 232.

The conducting metal piece 16 is isolated from the metallic flange base 40 by the insolation cover 125 and is connected to the outer electric source by means of a conductor passing through the penetrating hole 90.

The metal enclosure 22 enclosing the electro magnetic induction coil 20 is fixed on the metallic flange base 40 by means of the screw nut 24 and a metal washer 25 on its top and another metal washer 25 at the bottom.

The platinum filament 17 in a spiral shape is connected to the end of the metal wrapped cylinder 132 at one terminal and to the conductive metal piece 15 at the other terminal, the upper conductive metal piece 15 is isolated from the metallic flange base 40 by the insulation cover 124.

The metal flange base 40 is threaded with M8 threads on its surface so that it can be fixed to other part. The incoming conductor may pass through the penetrating hole 90 opened on said base 40 and connect with the conductive metal piece 16.

Before the coil 20 is energized, as seen in FIG. 4A, the metal wrapped cylinder 132 in contact with the conductive metal piece 16 allows the current to flow through said cylinder 132 to the platinum filament 17 installed at the end terminal of the cylinder 132. The heat produced by the infrared filament ignites the combustion gas, and the current flows continuously onwards via conductive metal piece 15 and flows out from the metallic flange base 40. When the coil is energized, as seen in FIG. 4B, the magnetic permeable bolt 232 attracts the metal wrapped cylinder 132 resulting in separation of conducting metal piece 16 from the metal wrapped cylinder 132 to cut off current to the platinum filament 17.

In conclusion, the outstanding features of the electro magnetic controlled platinum infrared filament ignitor of the present invention can be enumerated as follows:

1. Since the igniting position is adjustable, different ignitor locations can be selected at random for better igniting efficiency according to different requirements. In addition this position adjustable ignitor is effective in any application field.

2. Simple and firm in structure, with no need of additional peripheral equipment except an outside electric source.

3. The entire infrared platinum filament is useful for ignition which enlarges the effective zone of ignition.

4. After ignition is accomplished, the ignitor can be drawn back to the isolating chamber without exposing it to the high temperature or high pressure environment as in the conventional infrared filament ignitor, and according the high energy for ignition is not necessary.

5. The interference of the flow of combustion gas will not occur, and returning of the ignitor to the isolating chamber after completion of ignition assures uniform flow of the cooling air helpful for improving the cooling effect.

Many changes and modifications in the above described embodiment of the invention can, of course, be carried out without departing from the scope thereof. Accordingly, the promote the progress in science and the useful arts, the invention is disclosed and is intended to be limited only by the scope of the appended claims.

What is claimed is:

1. An electro magnetic controlled platinum infrared filament ignitor comprising:

a top pin made of magnetic permeable metallic material;

an electro magnetic induction coil wound around a magnetic permeable bolt for establishing a magnetic field when carrying a current to attract the top pin;

a metal wrapped cylinder made of conductive metal in contact with the top pin and movable between extended and retracted positions;

a metal enclosure enclosing the electro magnetic induction coil;

a platinum filament in a spiral shape around a portion of the metal wrapped cylinder, with one terminal connected to the metal wrapped cylinder and another terminal connected to conducting metal pieces, and movable with the metal wrapped cylinder between extended and retracted positions;

a metallic flange base electrically connected to the conducting metal pieces; and a screw nut adjustably threaded onto the top pin such that it contacts the magnetic permeable bolt when the platinum filament and the metal wrapped cylinder are in their extended positions, whereby adjusting the screw nut relative to the top pin adjusts the extended position of the platinum filament.

2. The electro magnetic controlled platinum infrared filament ignitor as claimed in claim 1, wherein the electro magnetic induction coil is electrically insulated from the metal enclosure by two insulating washers provided above and beneath the coil respectively.

3. The electro magnetic controlled platinum infrared filament ignitor as claimed in claim 1, further comprising a coil spring around the metal wrapped cylinder isolated from the top pin and the metallic flange base by two insulation covers provided on a top and a bottom respectively whereby, after the coil is de-energized, the coil spring biases the metallic wrapped cylinder to the retracted position.

4. The electro magnetic controlled platinum infrared filament ignitor as claimed in claim 1, wherein a first terminal of the platinum filament is connected to an end of the metal wrapped cylinder, while a second terminal is connected to two conductive metal pieces, an upper conductive metal piece is isolated from the metallic flange base by an insulation cover.

5. An electro magnetic controlled platinum infrared filament ignitor comprising:

a metal wrapped cylinder made of conductive metal movable between extended and retracted positions;

a magnetic permeable bolt made of magnetic material;

an electro magnetic induction coil wound around the magnetic permeable bolt for establishing a magnetic field when carrying a current to attract the metal wrapped cylinder and move it to the retracted position;

two metal pieces made of conductive metal;

a metal enclosure enclosing the electro magnetic induction coil;

a platinum filament in a spiral shape around a portion of the metal wrapped cylinder so as to move between extended and retracted positions therewith, with one terminal connected to an end of the metal wrapped cylinder and another terminal to the conductive metal pieces; and a metallic flange base to which is attached the metal enclosure and the magnetic permeable bolt, wherein the magnetic permeable bolt is threaded onto the metallic flange base and isolated from said base by an insulation cover on which the two metal pieces of conductive metal are attached.

6. The electro magnetic controlled platinum infrared filament ignitor as claimed in claim 5, wherein the electro magnetic induction coil is isolated from the metal enclosure by two insulating washers provided above and beneath it respectively.

7. The electro magnetic controlled platinum infrared filament ignitor as claimed in claim 5, wherein a third conducting metal piece is insulated from the metallic flange base by an insulation cover.

8. The electro magnetic controlled platinum infrared ignitor as claimed in claim 5, wherein an upper one of the two conductive metal pieces is insulated from the metallic flange base by an insulation cover.

9. The electro magnetic controlled platinum infrared filament ignitor comprising:

a top pin made of magnetic permeable metallic material;

an electro magnetic induction coil wound around a magnetic permeable bolt for establishing a magnetic field when carrying a current to attract the top pin;

a metal wrapped cylinder made of conductive metal in contact with the top pin and movable between extended and retracted positions;

a metal enclosure enclosing the electro magnetic induction coil;

a platinum filament in a spiral shape around a portion of the metal wrapped cylinder, with one terminal connected to the metal wrapped cylinder and the other terminal connected to conducting metal pieces and movable with the metal wrapped cylinder between extended and retracted positions; and a metallic flange base electrically connected to the conducting metal pieces, wherein the magnetic permeable bolt has a hollow inner portion, an upper part insulated from the top pin by an insulation cover and threads at a lower portion for threading onto the metal flange base.

10. The electro magnetic controlled platinum infrared filament ignitor comprising:

a top pin made of magnetic permeable metallic material;

an electro magnetic induction coil around a magnetic permeable bolt for establishing a magnetic field when carrying a current to attract the top pin;

a metal wrapped cylinder made of conductive metal in contact with the top pin and movable between extended and retracted positions;

a metal enclosure enclosing the electro magnetic induction coil;

a platinum filament in a spiral shape wound around a portion of the metal wrapped cylinder, with one terminal connected to the metal wrapped cylinder and the other terminal connected to conducting metal pieces and movable with the metal wrapped cylinder between extended and retracted positions;

a metallic flange base electrically connected to the conducting metal pieces, wherein the metal enclosure is attached to the metallic flange base by means of a screw nut and metal washers on a top and a bottom respectively.

11. An electro magnetic controlled platinum infrared filament ignitor comprising:

a metal wrapped cylinder made of conductive metal movable between extended and retracted positions;

a magnetic permeable bolt made of magnetic material;

an electro magnetic induction coil wound around the magnetic permeable bolt for establishing a magnetic field when carrying a current to attract the metal wrapped cylinder and move it to the retracted position;

two metal pieces made of conductive metal;

a metal enclosure enclosing the electro magnetic induction coil;

a platinum filament in a spiral shape around a portion of the metal wrapped cylinder so as to move between extended and retracted positions therewith, with one terminal connected to an end of the metal wrapped cylinder and another terminal to the conductive metal pieces; and a metallic flange base to which is attached the metal enclosure and the magnetic permeable bolt, wherein the metal wrapped cylinder is hollow and contains a spring, the metal wrapped cylinder being insulated from the magnetic permeable bolt and the metallic flange base by an insulating washer and an insulation cover on an upper and a lower portion respectively, such that after the coil is de-energized, the metal wrapped cylinder returns to the extended position by a biasing force of the spring.

12. An electro magnetic controlled platinum infrared filament ignitor comprising:

a metal wrapped cylinder made of conductive metal movable between extended and retracted positions;

a magnetic permeable bolt made of magnetic material;

an electro magnetic induction coil wound around the magnetic permeable bolt for establishing a magnetic field when carrying a current to attract the metal wrapped cylinder and move it to the retracted position;

two metal pieces made of conductive metal;

a metal enclosure enclosing the electro magnetic induction coil;

a platinum filament in a spiral shape around a portion of the metal wrapped cylinder so as to move between extended and retracted positions therewith, with one terminal connected to an end of the metal wrapped cylinder and another terminal to the conductive metal pieces; and a metallic flange base to which is attached the metal enclosure and the magnetic permeable bolt, wherein the metal enclosure is attached to the metallic flange base by means of a screw nut and a first metal washer on a top and a second metal washer at a bottom.

13. An electro magnetic controlled platinum infrared filament ignitor comprising:

a metal wrapped cylinder made of conductive metal movable between extended and retracted positions;

a magnetic permeable bolt made of magnetic material;

an electro magnetic induction coil wound around the magnetic permeable bolt for establishing a magnetic field when carrying a current to attract the metal wrapped cylinder and move it to the retracted position;

two metal pieces made of conductive metal;

a metal enclosure enclosing the electro magnetic induction coil;

a platinum filament in a spiral shape around a portion of the metal wrapped cylinder so as to move between extended and retracted positions therewith, with one terminal connected to an end of the metal wrapped cylinder and another terminal to the conductive metal pieces; and a metallic flange base to which is attached the metal enclosure and the magnetic permeable bolt, wherein the metal flange base is threaded onto the magnetic permeable bolt and is provided with a penetrating hole for an incoming conductor to pass through it and connect with the conductive metal piece.

* * * * *